US006689996B2

(12) United States Patent
Shon et al.

(10) Patent No.: US 6,689,996 B2
(45) Date of Patent: Feb. 10, 2004

(54) MICROWAVE OVEN AND METHOD OF CONTROLLING THEREOF

(75) Inventors: Jong-Chull Shon, Suwon (KR); Kaun-Beuk Oh, Suwon (KR); So-Hyun Lee, Suwon (KR); Won-Woo Lee, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 102 days.

(21) Appl. No.: 10/005,198

(22) Filed: Dec. 7, 2001

(65) Prior Publication Data

US 2003/0116561 A1 Jun. 26, 2003

(51) Int. Cl.[7] ..... H05B 6/68

(52) U.S. Cl. ..... 219/707; 219/757; 219/400; 219/705; 99/325

(58) Field of Search ..... 219/707, 704, 219/705, 702, 720, 681, 757, 400; 99/451, 325; 426/241, 243

(56) References Cited

U.S. PATENT DOCUMENTS 4,162,381 A * 7/1979 Buck ..... 219/707
4,181,744 A * 1/1980 Buck ..... 219/757
4,582,971 A * 4/1986 Ueda ..... 219/757

FOREIGN PATENT DOCUMENTS

JP 7-318077 * 12/1995
KR 2001-090951 * 10/2001

* cited by examiner

*Primary Examiner*—Philip H. Leung
(74) *Attorney, Agent, or Firm*—Staas & Halsey LLP

(57) ABSTRACT

A microwave oven having an improved air outlet and humidity sensor mounting structure includes a body partitioned in its interior into a cooking cavity and a machine room, and a cooling fan installed in the machine room which draws atmospheric air into the cooking cavity while cooling a variety of elements installed in the machine room. In the microwave oven, an air outlet unit discharges air from the cooking cavity, and the humidity sensor senses a cooking atmosphere of the cooking cavity. This microwave oven further comprises a control unit which determines the conditions of food in response to automatically or manually inputted information, and controls the rpm of the cooling fan in response to the determined conditions of the food so as to improve the sensing performance of the humidity sensor.

37 Claims, 6 Drawing Sheets

MICROWAVE OVEN AND METHOD OF CONTROLLING THEREOF

BACKGROUND OF THE INVENTION

1. Field of the Invention

The present invention relates to microwave ovens and, more particularly, to a microwave oven designed to improve a sensing performance of its humidity sensor used to sense humidity in a cooking cavity of the microwave oven by sensing the humidity of air exhausted from the cooking cavity, and to a method of controlling the microwave oven.

2. Description of the Related Art

A microwave oven is an electrically operated oven using a magnetron to generate high-frequency electromagnetic waves. The high-frequency electromagnetic waves have a fundamental frequency of 2450 MHz, and are radiated into a cooking cavity to repeatedly change the molecular arrangement of moisture laden in food and generate intermolecular frictional heat within the food to cook the food.

In recent years, in order to meet a variety of requirements of consumers, a microwave oven with a humidity sensor has been proposed and used. In an operation of such a microwave oven, the humidity sensor senses the humidity of air inside the cooking cavity, and automatically controls the cooking process according to the sensed humidity.

FIG. 1 shows a conventional microwave oven with a humidity sensor 6. A body 1 of the microwave oven is partitioned into a cooking cavity 2 and a machine room 3. A door 4 is hinged to the body 1 so as to close the cooking cavity 2. The microwave oven also has a control panel 5, which is installed at a front wall of the body 1 and is provided with a variety of control buttons. The humidity sensor 6 is installed in the body 1 to sense the operational conditions of the food being cooked in the cooking cavity 2.

The cooking cavity 2 is opened at its front and has a turntable-type cooking tray 2*a* rotatably mounted on a bottom of the cooking cavity 2. An air inlet 7*a* is formed at a front portion of a sidewall 7 of the cooking cavity 2 so as to allow the cooking cavity 2 to communicate with the machine room 3. Air flows from the machine room 3 into the cooking cavity 2 through the air inlet 7*a*. An air outlet 8*a* is formed at a rear portion of an opposite sidewall 8 of the cooking cavity 2 so as to discharge air from the cooking cavity 2 to the atmosphere exterior to the body 1.

A magnetron 3*a*, a cooling fan 3*b*, and an air guide duct 3*c* are installed within the machine room 3. The magnetron 3*a* generates the high-frequency electromagnetic waves, while the cooling fan 3*b* sucks atmospheric air into the machine room 3 so as to cool the elements such as the magnetron 3*a* installed within the machine room 3. The air guide duct 3*c* guides air inside the machine room 3 to the air inlet 7*a*. The cooling fan 3*b* is installed at a position between the magnetron 3*a* and a rear wall of the machine room 3. In order to allow atmospheric air to flow into the machine room 3 from outside the body 1, a predetermined area of the rear wall of the machine room 3 is perforated to form a plurality of air suction holes 3*d*.

The humidity sensor 6 is installed on the sidewall 8 of the cooking cavity 2 at a position adjacent to the air outlet 8*a* such that it is placed in an air discharging passage leading from the cooking cavity 2. The humidity sensor 6 senses the humidity of exhaust air discharged from the cooking cavity 2 through the air outlet 8*a*. The humidity sensor 6 is connected to a circuit board (not shown) installed in the control panel 5, and outputs a signal to the circuit board.

When turning on the microwave oven containing food on the cooking tray 2*a* by manipulating the control panel 5, the high-frequency electromagnetic waves are radiated from the magnetron 3*a* into the cooking cavity 2 to cook the food. During such an operation, the cooling fan 3*b* is rotated to form a suction force which draws the atmospheric air into the machine room 3 through the air suction holes 3*d* and cools the elements such as the magnetron 3*a* installed in the machine room 3. The air is, thereafter, guided to the air inlet 7*a* by the air guide duct 3*c* and introduced into the cooking cavity 2 through the air inlet 7*a*. The air inside the cooking cavity 2 is exhausted along with vapor generated from the food being cooked to the atmosphere through the air outlet 8*a* as shown by the arrows of FIG. 1. Therefore, it is possible to remove odor and vapor generated from food during the operation of the microwave oven.

When the exhaust air flows from the cooking cavity 2 to the atmosphere, it comes into contact with the humidity sensor 6. The humidity sensor 6 senses the humidity of the exhaust air, and outputs a signal to the circuit board of the control panel 5. To automatically cook the food on the tray 2*a*, the circuit board of the control panel 5 controls the operation of the magnetron 3*a*, the cooking tray 2*a* and the cooling fan 3*b* in response to the signal from the humidity sensor 6.

However, the conventional microwave oven is problematic due to the humidity sensor 6 being installed at a position close to the air outlet 8*a* which discharges air from the cooking cavity 2 to the atmosphere. Specifically, when the microwave oven sequentially performs several cooking processes, the air inside the cooking cavity 2 is excessively heated and discharged to the atmosphere through the air outlet 8*a*. Thus overheating of the humidity sensor 6, which reduces the sensing performance of the humidity sensor 6. In addition, moisture and contaminants, such as oil and smoke, generated from the food during the cooking processes are deposited onto the surface of the humidity sensor 6 as the moisture and contaminants flows from the cooking cavity 2 to the atmosphere along with the exhaust air through the air outlet 8*a*. The moisture and contaminants deposited on the surface of the humidity sensor 6 are not easily removed from the humidity sensor 6, and the sensing performance of the humidity sensor 6 is reduced.

Furthermore, when the amount of food in the cooking cavity 2 is large, the air does not smoothly circulate in the cooking cavity 2. Thus, the amount of exhaust air discharged from the cooking cavity 2 through the air outlet 8*a* is reduced. In such a case, the sensing performance of the humidity sensor 6 installed outside the air outlet 8*a* is remarkably reduced. Therefore, a microprocessor (not shown) set on the circuit board of the control panel 5 is unable to precisely determine the cooked state of the food, and the food is either undercooked or overcooked.

SUMMARY OF THE INVENTION

Accordingly, it is an object of the present invention is to provide a microwave oven with an improved air outlet and humidity sensor mounting structure to prevent the humidity sensor from being overheated or contaminated by air exhausted from a cooking cavity, and to allow the humidity sensor to precisely sense the humidity of the air inside the cooking cavity during a cooking process.

Another object of the present invention is to provide a microwave oven which controls the air flow speed inside a cooking cavity to improve the sensing performance of a humidity sensor, and a method of controlling the operation of the microwave oven.

Additional objects and advantages of the invention will be set forth in part in the description which follows and, in part, will be obvious from the description, or may be learned by practice of the invention.

To achieve the above and other objects of the present invention, there is provided a microwave oven according to an embodiment if the present invention includes a control unit which determines the conditions of food being cooked in response to automatically or manually inputted information and controls the rotational speed of a cooling fan in response to the determined conditions of the food to improve the sensing performance of a humidity sensor.

According to another embodiment of the present invention, a method of controlling a microwave oven includes receiving input information of food to be cooked, determining the rotational speed of a cooling fan in accordance with the conditions of the food determined by using the input information, and operating the cooling fan at the determined rotational speed and cooking the food.

BRIEF DESCRIPTION OF THE DRAWINGS

The above and other objects and advantages of the present invention will become more apparent by describing in detail preferred embodiments thereof with references to the accompanying drawings in which.

DETAILED DESCRIPTION OF THE PREFERRED EMBODIMENTS

Figure 1:
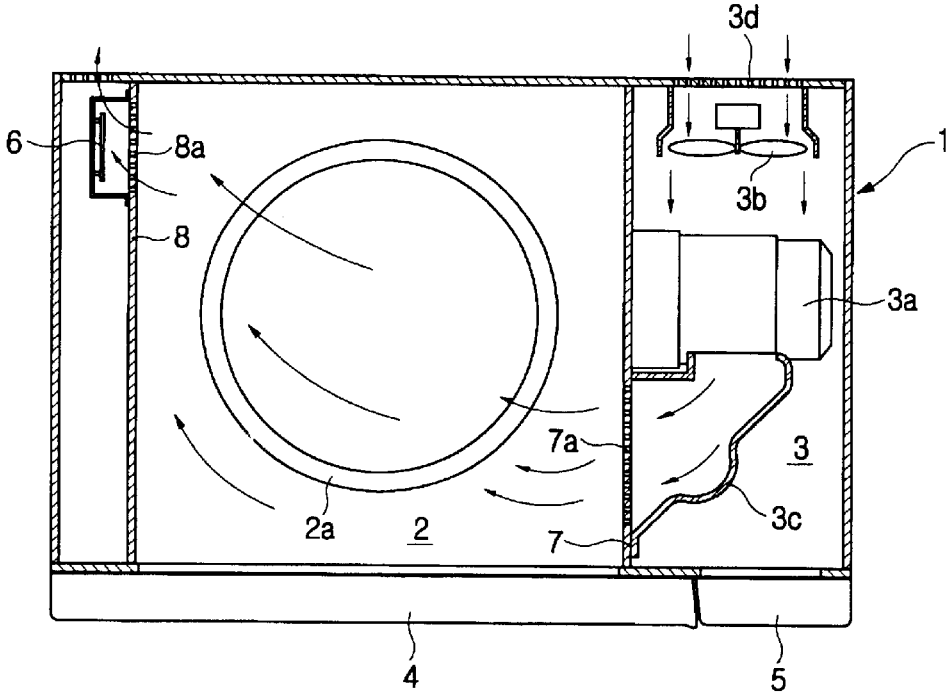
FIG. 1 (PRIOR ART)
FIG. 1 is a diagram illustrating a sectional view of a conventional microwave oven with a humidity sensor.

Reference will now be made in detail to preferred embodiments of the present invention, examples of which are illustrated in the accompanying drawings, wherein like reference numerals refer to the like elements throughout. The embodiments are described below in order to explain the present invention by referring to the figures.

Figure 2:
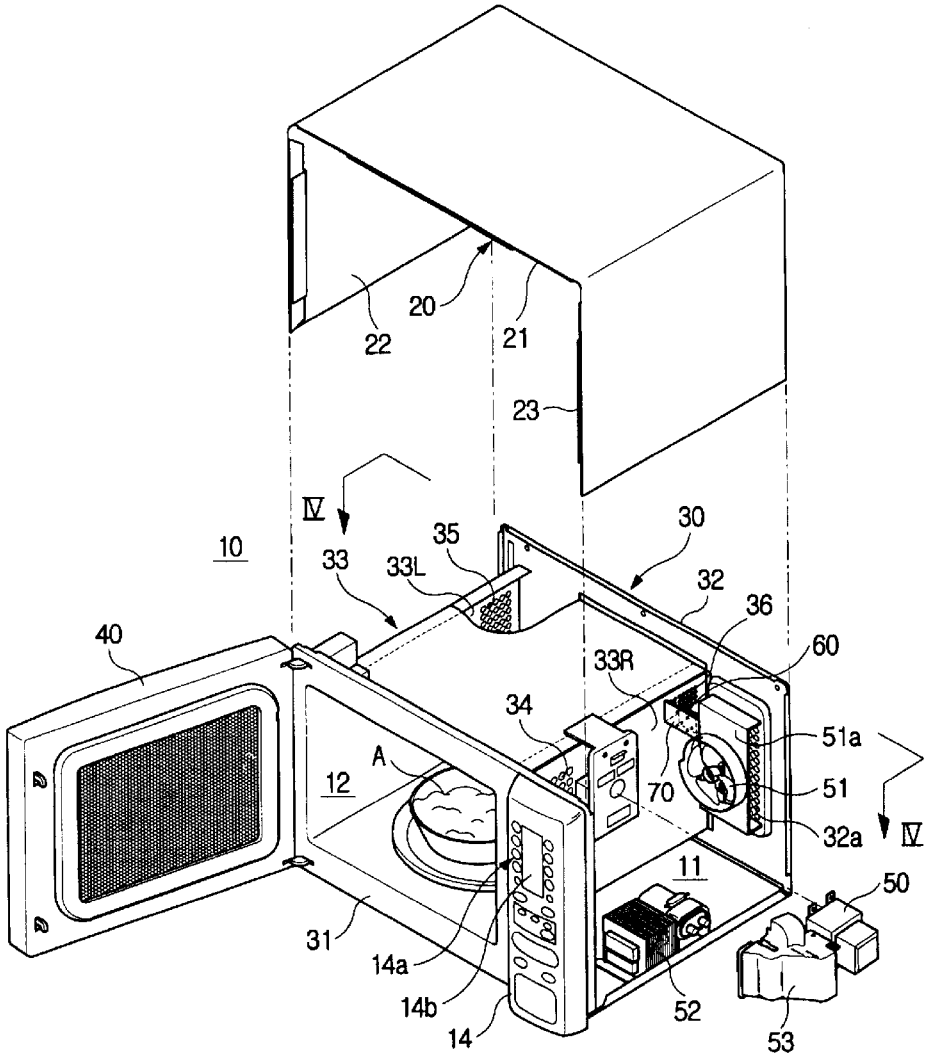
FIG. 2 is a diagram with an exploded perspective view of a microwave oven with a humidity sensor according to an embodiment of the present invention.
Figure 3:
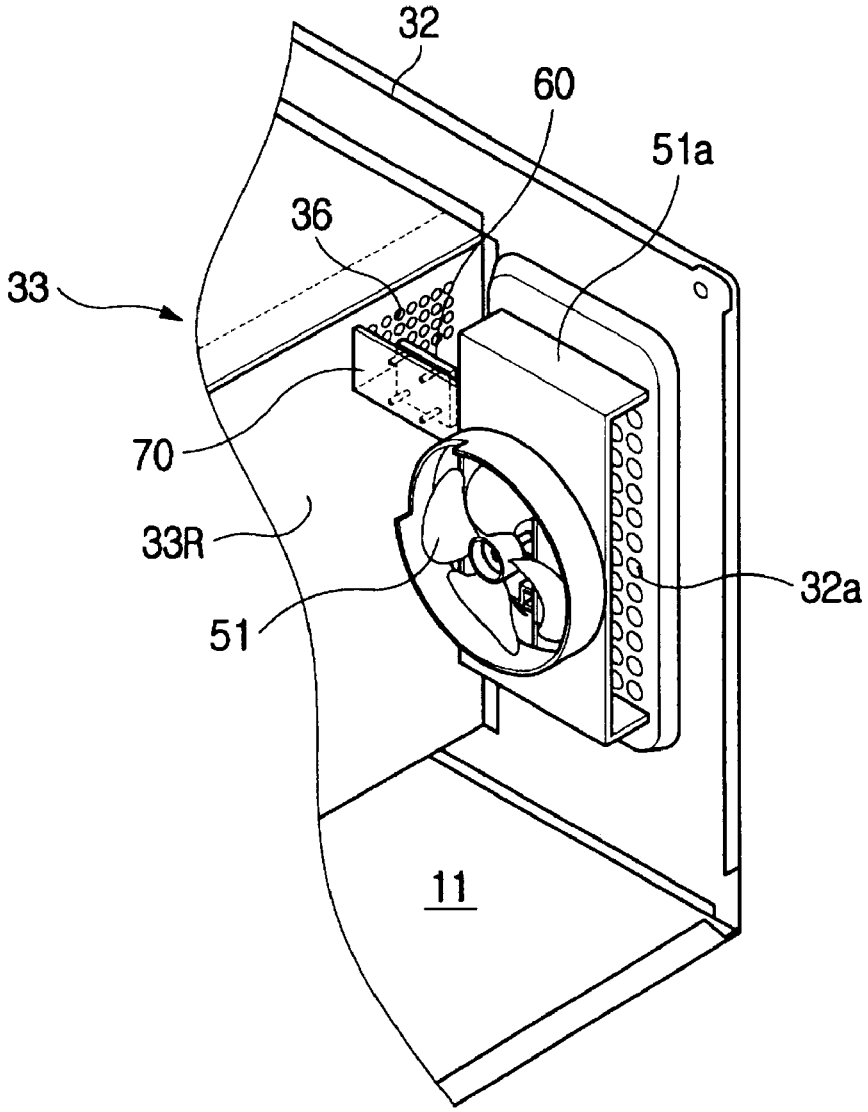
FIG. 3 is a diagram of a perspective view showing a humidity sensor mounting structure provided in the microwave oven of an embodiment of the present invention.
Figure 4:
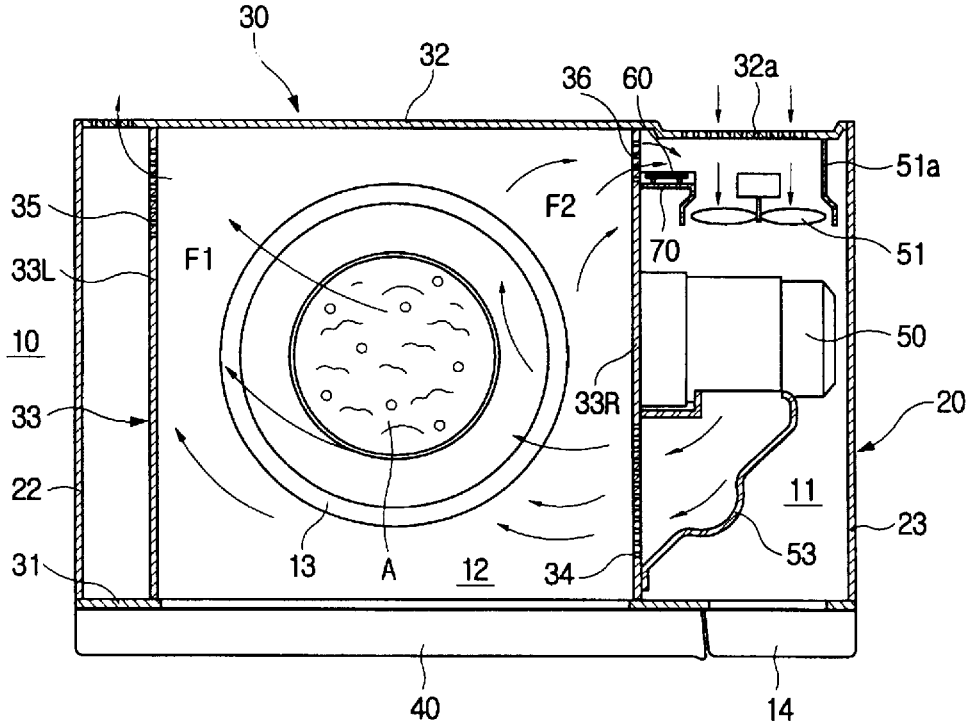
FIG. 4 is a diagram illustrating a sectional view taken along the line IV—IV of FIG. 2, showing an air outlet structure for discharging air from a cooking cavity of the microwave oven of the present invention.

FIGS. 2 and 3 show the interior of a microwave oven according to an embodiment of the present invention. FIG. 4 shows an air circulation structure of the microwave oven of the present invention. As shown in FIG. 2, the microwave oven including a body 10, the interior of which is partitioned into a machine room 11 and a cooking cavity 12. A turntable-type cooking tray 13 is rotatably mounted on a bottom of the cooking cavity 12. A door 40 is hinged to the front edge of the body 10 so as to close the cooking cavity 12. This microwave oven also has a control panel 14, which is installed at a front wall of the machine room 11 and has a circuit board (not shown) to control an operation of the microwave oven. The control panel 14 has an input unit 14*a* provided with a plurality of control buttons to allow a user to input command signals, and a display unit 14*b* to display information. A humidity sensor 60 is installed in the body 10 to sense the operational conditions of the cooking cavity 12 by sensing the humidity of air inside the cooking cavity 12. For example, the air inside the cooking cavity 12 is humidified by vapor generated from food A during a cooking process. The humidity sensor 60 is connected to the circuit board of the control panel 14, senses the humidity, and outputs a signal to the circuit board.

The body 10 includes of an inner casing 30 and an outer casing 20. The inner casing 30 defines the cooking cavity 12 therein, while the outer casing 20 is detachably assembled with the inner casing 30 and defines the machine room 11 separated from the cooking cavity 12.

The outer casing 20 has an inverted U-shaped cross-section, with two sidewalls 22 and 23 covering outer side portions of the inner casing 30 and one top wall 21 covering a top portion of the inner casing 30. The front and rear edges of the outer casing 20 engage with front and rear plates 31 and 32 of the inner casing 30 forming an appearance of the microwave oven.

The inner casing 30 comprises a box-shaped housing 33 in addition to the front and rear plates 31 and 32. The housing 33 defines a cooking cavity 12 therein. The front plate 31 is mounted to a front end of the housing 33 and defines the front opening of the cooking cavity 12, while the rear plate 32 is mounted to a rear end of the housing 33 so as to close the rear end of the cooking cavity 12. The front and rear plates 31 and 32 are wide enough to have extensions acting as the front and rear walls of the machine room 11. The control panel 14 is installed on the extension of the front plate 31, while a plurality of air suction holes 32*a* are formed at the extension of the rear plate 32 so as to allow the atmospheric air to flow from outside the body 10 into the machine room 11.

A magnetron 50, a high-tension transformer 52, a cooling fan 51, and an air guide duct 53 are installed within the machine room 11. The magnetron 50 generates high-frequency electromagnetic waves that are radiated into the cooking cavity 12 to cook the food A. The high-tension transformer 52 applies a high voltage to the magnetron 50. The cooling fan 51 sucks the atmospheric air into the machine room 11 so as to cool the elements such as the magnetron 50 installed within the machine room 11. An air guide duct 53 (FIG. 4) guides air from the machine room 11 into the cooking cavity 12. A fan bracket 51*a* is installed inside a rear section of the machine room 11 at a position close to the air suction holes 32*a* of the rear plate 32. The cooling fan 51 is rotatably mounted to the fan bracket 51*a*. The air guide duct 53 surrounds an air inlet 34 formed at a sidewall 33R of the housing 33 of the inner casing 30.

When the cooling fan 51 is rotated, the atmospheric air is sucked into the machine room 11 through the air suction holes 32*a,* thus cooling the elements inside the machine room 11. Thereafter, the air flows from the machine room 11 into the cooking cavity 12 through the air inlet 32*a* under the guide of the air guide duct 53. The sidewalls 33L and 33R of the cooking cavity 12 are provided with an air outlet unit to discharge air from the cooking cavity 12 along with vapor generated from food A. The air outlet unit includes of two air outlets, a main-outlet 35 and a sub-outlet 36 formed at the sidewalls 33L and 33R of the cooking cavity 12. The humidity sensor 60 is arranged such that it comes into contact with exhaust air discharged from the cooking cavity 12 through the sub-outlet 36. The construction of the air outlet unit and the mounting structure for the humidity sensor 60 will be described in detail below.

The main-outlet 35 is formed at the rear portion of the sidewall 33L of the housing 33 of the inner casing 30 defining the cooking cavity 12. The main-outlet 35 allows the cooking cavity 12 to communicate with the atmosphere exterior to the body 10. The air inlet 34 includes a plurality of air inlet holes formed at the front portion of opposite sidewall 33R of the housing 33. The air inlet 34 thus allows the cooking cavity 12 to communicate with the machine room 11. The air inlet 34 and the main-outlet 35 are formed at the two sidewalls 33L and 33R of the housing 33 while being diagonally opposite to each other, so as to effectively circulate the air within the cooking cavity 12 prior to discharge from the cooking cavity 12 to the atmosphere.

The sub-outlet 36 is formed at the rear portion of the sidewall 33R of the housing 33 so as to allow the cooking cavity 12 to communicate with the machine room 11. This sub-outlet 36 discharges a part of the air exhausted from the cooking cavity 12 to the air inlet side of the cooling fan 51 installed in the machine room 11.

As shown in FIGS. 3 and 4, the humidity sensor 60 is arranged at the rear section of the machine room 11 so as to be close to the sub-outlet 36. An air guide 70 is provided in the machine room 11 to mount the humidity sensor 60 in the room 11. The air guide 70 also guides air from the sub-outlet 36 to the air inlet side of the cooling fan 51. The air guide 70 provides a close connection of the sub-outlet 36 with the air inlet side of the cooling fan 51. According to an embodiment of the present invention, the air guide 70 is cast with the fan bracket 51*a* into a single structure through a plastic injection molding process. However, it is understood that other techniques are available to attach the air guide 70 in the machine room 11.

The humidity sensor 60 is mounted on a rear surface of the air guide 70 such that it is close to both the air suction holes 32*a* and the sub-outlet 36. Therefore, the air discharged from the cooking cavity 12 through the sub-outlet 36 flows to the air inlet side of the cooling fan 51 under the guide of the air guide 70 while coming into contact with the humidity sensor 60. In addition, the atmospheric air, which is sucked into the machine room 11 through the air suction holes 32*a* by the suction force of the cooling fan 51, comes into contact with the humidity sensor 60. This contact effectively removes moisture deposited on the surface of the sensor 60.

While designing a microwave oven of according to an embodiment of the present invention, it is necessary to set the relative areas of the main-outlet 35 and the sub-outlet 36 are set such that the humidity sensor 60 reliably maintains 50% or more of its ideal sensing performance. In order to accomplish this performance goal, the two outlets 35 and 36 are designed such that the ratio of the area of the sub-outlet 36 to the total area of both the outlets 35 and 36 is set to be roughly between 10 and 25%. In addition, between the sensing performance of the humidity sensor 60 is controlled by controlling the rotational speed of the cooling fan 51 in accordance with the relative areas of the main-and sub-outlets 35 and 36. Such design factors for controlling the sensing performance of the humidity sensor 60 were determined in accordance with several experiments carried by the inventors of this invention, and will be described in more detail with reference to Table 1. The Table 1. shows a variation in the sensing performance of a humidity sensor 60 in accordance with the rotational speed of a cooling fan 51 and ratios of areas of main- and sub-outlets 35 and 36 to total area of both outlets 35 and 36

TABLE 1

| Performance of humidity sensor | Fan rpm | Area of air inlet | Main-outlet | Sub-outlet | Loss |
|---|---|---|---|---|---|
| 100% | 2700 | 100% | 70% | 25% | 5% |
| 70% | 2700 | 100% | 76% | 19% | 5% |
| 50% | 2700 | 100% | 80% | 15% | 5% |
| 0% | 2700 | 100% | 80% | 10% | 5% |
| 50% | 1800 | 100% | 80% | 15% | 5% |
| 70% | 500 | 100% | 80% | 15% | 5% |
| 100% | 0 | 100% | 80% | 15% | 5% |

From Table 1, it is apparent that the sensing performance of the humidity sensor 60 is improved in accordance with an increase in the ratio of the area of the sub-outlet 36 to the total area of the two outlets 35 and 36 in the case of a fixed rpm of the cooling fan 51. However, the humidity sensor 60 may be easily overheated or contaminated on its surface by the air exhausted from the cooking cavity 12 as the ratio of the sub-outlet 36 to the total area of the two outlets 35 and 36 is increased. As also shown in Table 1, the sensing performance of the humidity sensor 60 is improved in accordance with a reduction in the rpm (i.e. the rotational speed) of the cooling fan 51 when the ratios of the areas of the main- and sub-outlets 35 and 36 to the total area of the two outlets 35 and 36 are fixed. However, when the rpm of the cooling fan 51 is excessively reduced, the elements installed in the machine room 11 are not sufficiently cooled, thus being undesirably overheated. Therefore, while designing the microwave oven of the present invention, the rpm of the cooling fan 51 is set such that it is changed within a predetermined range in inverse proportion to a preset ratio (10~25%) of the area of the sub-outlet 36 to the total area of both outlets 35 and 36.

When the cooling fan 51 is rotated at a high rpm, with a small amount of food contained in the cooking cavity 12 and fixed ratios of the areas of the main- and sub-outlets 35 and 36 to the total area of the two outlets 35 and 36, the amount of exhaust air from the main-outlet 35 is increased, while the amount of exhaust air from the sub-outlet 36 is reduced. In such a case, the sensing performance of the humidity sensor 60 is reduced. Therefore, it is necessary to reduce the rpm of the cooling fan 51 when a small amount of food is contained in the cooking cavity 12. On the contrary, when the amount of food in the cooking cavity 12 is too large, the air does not smoothly circulate within the cooking cavity 12. As such, it is necessary to increase the rpm of the cooling fan 51.

Therefore, according to an embodiment of the present invention, the ratio of the area of the sub-outlet 36 to the total area of the two outlets 35 and 36 is set to 10~25%. In addition, the rpm of the cooling fan 51 is set such that it is changed within a predetermined range in inverse proportion to the preset ratio of the area of the sub-outlet 36 to the total area of both outlets 35 and 36. In order to allow the humidity sensor 60 to maintain its ideal sensing performance at 100%, the ratio of the area of the main-outlet 35 to the total area of the two outlets 35 and 36 is set to about 70%, and the ratio of the area of the sub-outlet 36 to the total area is set to about 25%.

According to an aspect of the present invention, the microwave oven is designed such that the rpm of the cooling fan 51 is automatically controlled in accordance with input signals from the input unit 14*a,* the automatically sensed amount of food, and/or the kind of food contained in the cooking cavity 12.

Both the main-outlet 35 and the sub-outlet 36 includes of a plurality of holes having a small diameter capable of effectively preventing leakage of high-frequency electromagnetic waves from the cooking cavity 12. Further, the holes are large enough to allow for efficient circulation of air. In addition, it is understood the air inlet 34 and the outlets 35 and 36 can be disposed on other sidewalls, the top, or the bottom of the cooking cavity 12.

Figure 5:
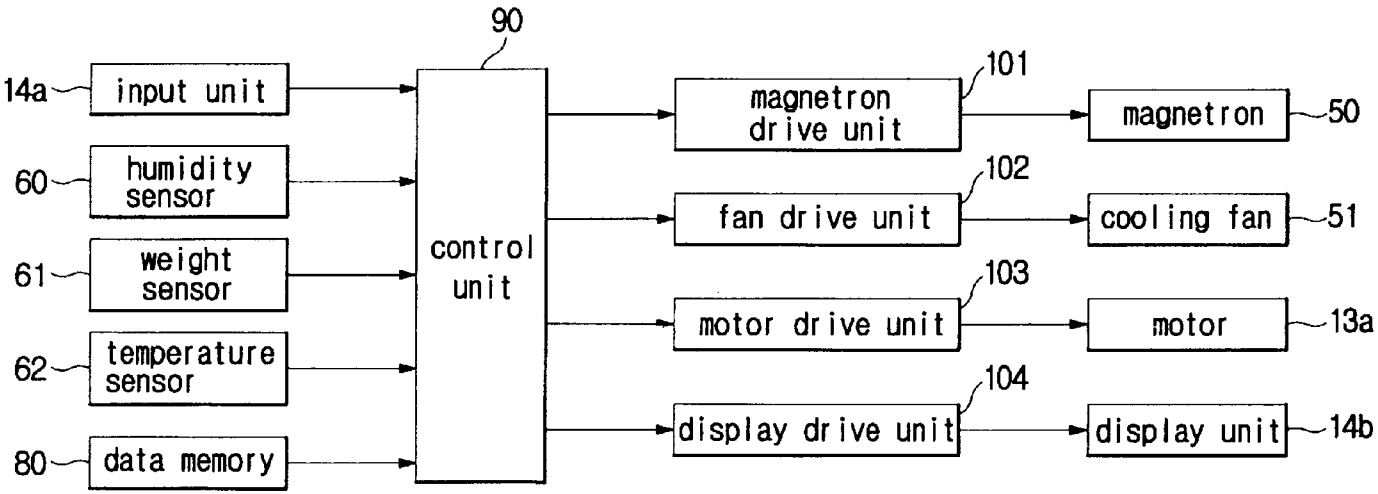
FIG. 5 is a block diagram of the microwave oven of an embodiment of the present invention.

FIG. 5 is a block diagram of the microwave oven of the present invention. As shown in FIG. 5, the microwave oven of the present invention has a control unit 90 controlling the operation of the oven. The control unit 90 can be a general or special purpose computer performing instructions encoded on a computer readable medium. The input unit 14*a* of the control panel 14 is connected to an input terminal of the control unit 90 to output command signals to the control unit 90 when a user manipulates the control buttons of the input unit 14*a*. The humidity sensor 60, a weight sensor 61, a temperature sensor 62 and a data memory 80 are connected to input terminals of the control unit 90. The output terminals of the control unit 90 are connected to a magnetron drive unit 101, a fan drive unit 102, a motor drive unit 103 and a display drive unit 104. The magnetron drive unit 101 drives the magnetron 50, while the fan drive unit 102 drives the cooling fan 51. In addition, the motor drive unit 103 drives a motor 13*a* to rotate the cooking tray 13, while the display drive unit 104 drives the display unit 14*b* of the control panel 14. It is understood that certain elements, such as the cooking tray 13, are not required in all aspects of the invention.

The data memory 80 is stored with preset rpm control data to automatically control the rpm of the cooling fan 51 in accordance with the amount and kind of food contained in the cooking cavity. The data memory 80 can be updated through portable storage devices or through a network connection as found in intelligent appliances.

The operation of the microwave oven of this invention will be described herein below. The operation may be stored as a computer program to be performed by the control unit 90.

In order to the cook food A using the microwave oven, the food A is put on the cooking tray 13 inside the cooking cavity 12. After putting the food A on the tray 13, the cooking cavity 12 is closed by the door 40 prior to manipulating the control buttons of the input unit 14*a* of the control panel 14 to start a desired cooking operation. The magnetron 50 radiates the high-frequency electromagnetic waves into the cooking cavity 12, and the molecular arrangement of moisture laden in the food A is repeatedly changed to generate the intermolecular frictional heat within the food A as to cook the food A.

In addition, the atmospheric air is sucked into the machine room 11 through the air suction holes 32*a* by the suction force of the cooling fan 51. The atmospheric air then cools the magnetron 50 and the high-tension transformer 52 prior to flowing into the cooking cavity 12 through the air inlet 34 under the guide of the air guide duct 53. In such a case, a part of the atmospheric air sucked into the machine room 11 comes into contact with the humidity sensor 60 positioned close to the air suction holes 32*a*. The air inside the cooking cavity 12 is laden with vapor generated from food A, and is discharged from the cooking cavity 12 to the atmosphere outside the body 10 through the two outlets 35 and 36.

A part of the air inside the cooking cavity 12 is discharged from the cooking cavity 12 to the atmosphere through the main-outlet 35 as shown by the arrows F1 of FIG. 4. The remaining air is discharged from the cooking cavity 12 into the machine room 11 through the sub-outlet 36 as shown by the arrows F2 of FIG. 4. In such a case, the air from the sub-outlet 36 comes into contact with the humidity sensor 60, and moisture laden in the air is condensed and deposited on the surface of the humidity sensor 60. Thereafter, resistance of the humidity sensor 60 is changed, and the changed resistance value of the humidity sensor 60 is converted into a signal that is output to the circuit board of the control panel 14.

In the machine room 11, the air guide 70 accomplishes a close connection of the sub-outlet 36 with the air inlet side of the cooling fan 51 as described above. The suction force of the cooling fan 51 is thus more reliably applied to the sub-outlet 36, and air is more smoothly discharged from the cooking cavity 12 to the air inlet side of the cooling fan 51.

The humidity sensor 60 senses the humidity of air exhausted from the cooking cavity 12 while coming into contact with a part of the air discharged from the cavity 12 through the sub-outlet 36. The surface of the humidity sensor 60 is not easily contaminated by contaminants laden in the exhaust air from the cooking cavity 12, and the humidity sensor 60 maintains its operational performance for a desired lengthy period of time. Specifically, during the cooking process, the amount of vapor generated from the food A is gradually reduced until there is no new moisture deposited on the surface of the humidity sensor 60. Then, the existing moisture deposited on the surface of the humidity sensor 60 is quickly evaporated and removed from the sensor's surface by the atmospheric air that is newly sucked into the machine room 11 due to the suction force of the cooling fan 51.

In an operation of the microwave oven of the present invention, the amount of moisture evaporated from the surface of the humidity sensor 60 is more than that newly deposited onto the sensor's surface, and the moisture is easily and quickly removed from the surface of the humidity sensor 60. Therefore, when a cooking process is ended, the humidity sensor 60 is restored to its initial state, capable of effectively and reliably performing its operation for a next cooking process.

Figure 6:
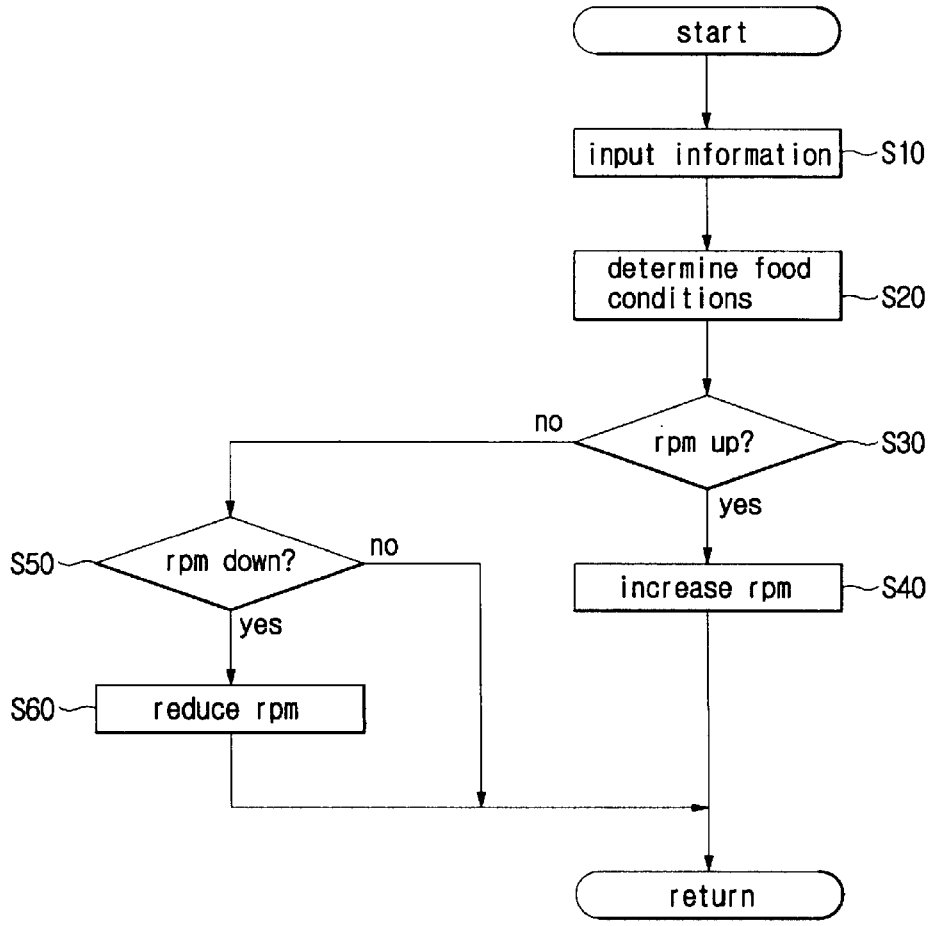
FIG. 6 is a flowchart illustrating a method of the controlling the microwave oven according to an embodiment of the present invention.

In the microwave oven of an embodiment of the present invention, the rpm of the cooling fan 51 is automatically controlled in accordance with input signals from the input unit 14*a,* the amount and/or kind of food contained in the cooking cavity 12. FIG. 6 shows a flowchart of the control method for the microwave oven of this invention.

As shown in FIG. 6, a user primarily selects a desired cooking mode at step S10. During the cooking mode selecting step, the user inputs information, such as the amount and kind of food and a desired cooking time, by manipulating the input unit 14*a* of the control panel 14. Of course, the user may select an automatic cooking mode in place of inputting detailed information.

For example, Table 2 shows an individualized initial rotational speed of the cooling fan 51 in accordance with a kind of food selected by the user according to an embodiment of the invention.

TABLE 2

| MENU | RPM (Rotational Speed of Cooling Fan) |
|---|---|
| Pizza | 2160 |
| Boil Water | 1920 |
| Popcorn | 2400 |
| Bacon | 1680 |

When the automatic cooking mode is selected at operation S10, the control unit 90 senses the weight of the food A put on the cooking tray 13 in response to a signal output from a weight sensor 61 installed at the tray 13.

After selecting a desired cooking mode, the control unit 90 determines the conditions of the food A put on the cooking tray 13 by using the automatically or manually inputted information at operation S20.

After determining the conditions of the food A, the control unit 90 compares the amount of the food A on the tray 13, determined using the automatically or manually inputted information in operation S20, with a preset reference amount so as to determine at operation S30 whether it is necessary to increase the rpm (i.e. the rotational speed) of the cooling fan 51. When the control unit 90 determines at operation S30 that the amount of the food A on the tray 13 is more than the preset reference amount such that the rpm of the cooling fan 51 to be increased, the control unit 90 outputs a control signal to the fan drive unit 102 so as to increase the rpm of the cooling fan 51 at operation S40.

However, when the control unit 90 determines at operation S30 that it is not necessary to increase the rpm of the cooling fan 51, the control unit 90 determines at operation S50 whether it is necessary to reduce the rpm of the cooling fan 51. When the control unit 90 determines at operation S50 that the amount of the food A on the tray 13, determined using the automatically or manually inputted information in operation S20, is not more than the preset reference amount such that the rpm of the cooling fan 51 is required to be reduced, the control unit 90 outputs a control signal to the fan drive unit 102 so as to reduce the rpm of the cooling fan 51 at operation S60. The rpm can be also reduced by a method including decreasing the rpm from a higher setting to a lower setting, shuttering the cooling fan on/off, and any combination thereof.

Therefore, the rpm of the cooling fan 51 is automatically controlled in accordance with the amount and/or kind of food contained in the cooking cavity, and the smooth circulation of air inside the cooking cavity improves the sensing performance of the humidity sensor 60.

As described above, the present invention provides a microwave oven having a humidity sensor at a predetermined location and a method of controlling the rpm of a cooling fan to improve the performance of the humidity sensor. Due to the improved location of the humidity sensor, the sensor's surface avoids excessive heat and is not likely to be contaminated by exhaust air from a cooking cavity. In addition, since the amount of moisture deposited on the surface of the humidity sensor is remarkably reduced just before an end of a cooking process, the moisture deposited on the sensor's surface is quickly and almost completely evaporated by atmospheric air sucked into a machine room by a cooling fan. Therefore, the humidity sensor is restored to its initial state capable of effectively and reliably performing its humidity sensing operation before a start of a next cooking process. The humidity sensor thus performs its desired operation even when the microwave oven sequentially performs several cooking processes. Moreover, the rpm of the cooling fan is automatically controlled in accordance with the amount and/or kind of food contained in the cooking cavity allowing a smooth circulation of air inside the cooking cavity and improving the sensing performance of the humidity sensor.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A microwave oven to cook food, comprising:

a body including a cooking cavity and a machine room;

a heating element to cook the food and which is installed in the machine room;

a cooling fan installed in the machine room which draws atmospheric air into the cooking cavity while cooling said heater element installed in the machine room;

an air outlet unit including a main-outlet and a sub-outlet at separate locations, to discharge air from the cooking cavity;

a humidity sensor to sense a atmosphere of the cooking cavity by sensing a humidity of the air discharged from the cooking cavity through the sub-outlet; and a control unit which determines conditions of the food in response to input information and controls a rotational speed of said cooling fan in response to determined conditions of the food so as to improve a sensing performance of said humidity sensor.

2. The microwave oven according to claim 1, wherein the main-outlet is formed at a first predetermined location of the cooking cavity to allow the cooking cavity to communicate with the atmosphere exterior to said body; and the sub-outlet is formed at a second predetermined location of the cooking cavity so as to allow the cooking cavity to communicate with an air inlet side of said cooling fan, wherein the main-outlet and the sub-outlet are designed such that a ratio of an area of the sub-outlet to a total area of the main-outlet and the sub-outlet is roughly between 15 and 25%, and said control unit controls said cooling fan so as to change the rotational speed of said cooling fan within a predetermined range in inverse proportion to the ratio of the area of the sub-outlet to the total area.

3. The microwave oven according to claim 2, further comprising an air guide provided in the machine room so as to allow said cooling fan to remove moisture formed on a surface of said humidity sensor to restore said humidity sensor to an initial state, wherein said humidity sensor is situated at said air guide which guides the atmospheric air from the sub-outlet to the air inlet side of said cooling fan.

4. The microwave oven according to claim 3, wherein said air guide is formed as part of a fan bracket, which holds said cooling fan.

5. The microwave oven according to claim 1, wherein said control unit controls said cooling fan so as to reduce the rotational speed of said cooling fan from a preset reference rotational speed in response to an amount of the food being determined using the input information to be less than a preset reference amount, and to increase the rotational speed of said cooling fan from the preset reference rotational speed in response to the amount of the food being determined using the input information to be more than the preset reference amount.

6. The microwave oven according to claim 5, wherein said control unit reduces the rotational speed of said cooling fan by one of decreasing the rotational speed from a higher setting to a lower setting, shuttering the cooling fan on/off, and/or any combination thereof.

7. The microwave oven according to claim 1, wherein said control unit controls said cooling fan to rotate at a preset rotational speed control data in accordance with an amount and/or kind of the food determined using the input information.

8. The microwave oven according to claim 1, wherein said air outlet unit comprises:

the main-outlet formed at a first predetermined location of the cooking cavity so as to allow the cooking cavity to communicate with the atmosphere exterior to said body; and the sub-outlet formed at a second predetermined location of the cooking cavity so as to allow the cooking cavity to communicate with an air inlet side of said cooling fan, wherein the main- and sub-outlets are have a ratio of an area of the sub-outlet to a total area of the main-outlet and the sub-outlet of roughly between 15 and 25%.

9. The microwave oven according to claim 8, wherein said control unit controls said cooling fan so as to reduce the rotational speed of said cooling fan from a preset reference rotational speed in response to an amount of the food being determined using the input information to be less than a preset reference amount, and to increase the rotational speed of said cooling fan from the preset reference rotational speed in response to the amount of the food being determined using the input information to be more than the preset reference amount.

10. The microwave oven according to claim 9, wherein said control unit reduces the rotational speed of said cooling fan by one of decreasing the rotational speed from a higher setting to a lower setting, shuttering said cooling fan on/off, and/or any combination thereof.

11. The microwave oven according to claim 10, further comprising an air guide provided in the machine room so as to allow said cooling fan to remove moisture formed on a surface of said humidity sensor to restore said humidity sensor to an initial state, wherein said humidity sensor is situated at said air guide which guides the atmospheric air from the sub-outlet to the air inlet side of said cooling fan.

12. The microwave oven according to claim 8, wherein said control unit controls said cooling fan so as to rotate said cooling fan at a preset rotational speed set by control data, wherein the control data comprises preset rotational speeds as a function of an amount and/or kind of the food determined using the input information.

13. The microwave oven according to claim 12, further comprising an air guide provided in the machine room so as to allow said cooling fan to remove moisture formed on a surface of said humidity sensor to restore said humidity sensor to an initial state, wherein said humidity sensor is situated at said air guide which guides the atmospheric air from the sub-outlet to the air inlet side of said cooling fan.

14. A method of controlling a microwave oven including a body having a cooking cavity and a machine room, a heating element to heat food, a cooling fan installed in the machine room which draws atmospheric air into the cooking cavity while cooling the heating element installed in the machine room, an air outlet unit to discharge air from the cooking cavity, and a humidity sensor to sense a cooking atmosphere of the cooking cavity, the method comprising:

receiving input information of the food to be cooked;

controlling a rotational speed of the cooling fan in accordance with conditions of the food determined using the input information, to improve a sensing performance of the humidity sensor; and operating the cooling fan at the controlled rotational speed and cooking the food.

15. The method according to claim 14, wherein said controlling the rotational speed of the cooling fan comprises reducing the rotational speed of the cooling fan from a preset reference rotational speed in response to an amount of the food being determined using the input information to be less than a preset reference amount, and increasing the rotational speed of the cooling fan from the preset reference rotational speed in response to the amount of the food being determined using the input information to be more than the preset reference amount.

16. The method according to claim 15, wherein said reducing the rotational speed of the cooling fan comprises one of decreasing the rotational speed from a higher setting to a lower setting, shuttering the cooling fan on/off, and/or any combination thereof.

17. The method according to claim 16, wherein the air outlet unit comprises a main-outlet and a sub-outlet, and a ratio of an area of the sub-outlet to a total area of the main-outlet and the sub-outlet is roughly between 15 and 25%.

18. The method according to claim 14, wherein said controlling the rotational speed of the cooling fan comprises rotating the cooling fan at a preset rotational speed set by control data, wherein the control data comprises preset rotational speeds as a function of an amount and/or kind of the food determined using the input information.

19. The method according to claim 18, wherein the air outlet unit comprises a main-outlet and a sub-outlet, and a ratio of an area of the sub-outlet to a total area of the main-outlet and the sub-outlet is roughly between 15 and 25%.

20. The method according to claim 14, wherein said controlling of the rotational speed of the cooling fan comprises changing the rotational speed of the cooling fan within a predetermined range in inverse proportion to a ratio of an area of a sub-outlet to a total area of a main-outlet and the sub-outlet, where air is exhausted from the cooking cavity using the main-outlet and the sub-outlet.

21. The method according to claim 20, wherein the ratio of the area of the sub-outlet to the total area of the main-outlet and the sub-outlet is roughly between 15 and 25%.

22. A computer readable medium encoded with processing instructions for implementing a method of controlling a microwave oven, including a humidity sensor, to cook food performed by a computer, the method comprising:

receiving input information of the food to be cooked;

determining a rotational speed of the cooling fans in accordance with conditions of the food determined using the input information to improve a sensing performance of the humidity sensor; and controlling a heating element to cook the food while controlling the cooling fan to rotate at the determined rotational speed.

23. The computer readable medium of claim 22, wherein said determining the rotational speed comprises:

identifying control data associated with the input information, and determining a preset rotational speed using the identified control data.

24. The computer readable medium of claim 23, wherein the control data is included in a control data set which comprises preset rotational speeds corresponding to different input information.

25. The computer readable medium of claim 22, wherein said controlling the heating element while controlling the cooling fan comprises:

rotating the cooling fan at a first rotational speed, and changing the cooling fan to the determined rotational speed.

26. A control unit for use in an oven having a cooking cavity in which food is to be cooked, comprising:

an input terminal which receives input information of the food to be cooked;

a determining unit, including a humidity sensor, which determines conditions of the food in response to the input information; and an air circulation unit that controls air circulated within a cooking cavity, in which the food is to be cooked, according to the determined condition of the food, to improve a sensing performance of the humidity sensor.

27. The control unit of claim 26, wherein the air circulation unit controls the air circulation by varying one of relative areas of outlets through which the air is exhausted from the cooking cavity and airflow speed by which the air flows through the cavity.

28. The control unit of claim 27, wherein said air circulation unit comprises a cooling fan and changes the airflow speed by changing a rotational speed of the cooling fan.

29. The control unit of claim 28, wherein said air circulation unit controls the cooling fan so as to reduce the rotational speed of the cooling fan from a preset reference rotational speed in response to an amount of the food being determined using the input information to be less than a preset reference amount, and to increase the rotational speed of the cooling fan from the preset reference rotational speed in response to the amount of the food being determined using the input information to be more than the preset reference amount.

30. The control unit of claim 29, wherein said air circulation unit reduces the rotational speed of the cooling fan by one of decreasing the rotational speed from a higher setting to a lower setting, shuttering the cooling fan on/off, and/or any combination thereof.

31. The control unit of claim 26, wherein said air circulation unit controls the air circulation to prevent overheating of both a humidity sensor that senses air exhausted from the cooking cavity and a heating element that cooks the food in the cooking cavity.

32. A microwave oven to cook food, comprising:

a body including a cooking cavity and a machine room;

a heating element to cook the food and which is installed in the machine room;

a cooling fan installed in the machine room which draws atmospheric air into the cooking cavity;

an air outlet unit including a main-outlet and a sub-outlet to discharge air from the cooking cavity;

a humidity sensor disposed in the sub-outlet to sense a cooking atmosphere of the cooking cavity; and a control unit which controls said cooling fan to vary a rotational speed of said cooling fan over a cooking period to improve a sensing performance.

33. The microwave oven of claim 32, wherein said control unit controls said cooling fan by intermittently turning off power to said cooling fan.

34. The microwave oven of claim 32, wherein said control unit controls said cooling fan in accordance with a type of food and/or an input information selected by a user.

35. A method of cooking food in a microwave oven including a body having a cooking cavity and a machine room, a heating element to heat food, a cooling fan installed in the machine room which draws atmospheric air into the cooking cavity, an air outlet unit having a main-outlet and a sub-outlet to discharge air from the cooking cavity, a humidity sensor disposed in the sub-outlet to sense a cooking atmosphere of the cooking cavity, and a control unit which controls the cooling fan to vary a rotational speed of the cooling fan, the method comprising:

placing the food in the cooking cavity of the microwave oven;

cooking the food using the heating element;

drawing the atmospheric air into the cooking cavity using the cooling fan;

discharging the air from the cooking cavity using the air outlet unit;

sensing the cooking atmosphere of the cooking cavity using the humidity sensor; and varying the rotational speed of the cooling fan using the control unit over a predetermined cooking period.

36. The method of claim 35, wherein said varying the rotational speed of the cooling fan comprises intermittently turning off power to the cooling fan.

37. The method of claim 35, wherein said varying the rotational speed of the cooling fan comprises controlling the cooling fan in accordance with a type of food and/or an input information selected by a user.

* * * * *

UNITED STATES PATENT AND TRADEMARK OFFICE

CERTIFICATE OF CORRECTION

PATENT NO. : 6,689,996 B2 
DATED : February 10, 2004
INVENTOR(S) : Jong-Chull Shon et al.

It is certified that error appears in the above-identified patent and that said Letters Patent is hereby corrected as shown below:

Title page,
Item [75], Inventors, change "Kaun-Beuk Oh" to -- Keun-Seuk Oh --;

Column 12,
Line 45, change "fans" to -- fan --.

Signed and Sealed this

First Day of June, 2004

JON W. DUDAS
*Acting Director of the United States Patent and Trademark Office*